United States Patent [19]

Buchinger et al.

[11] Patent Number: 4,719,946

[45] Date of Patent: Jan. 19, 1988

[54] METHOD OF PRODUCING A TUBULAR WOVEN FABRIC AND A CIRCULAR LOOM FOR CARRYING OUT THE METHOD

[75] Inventors: Johann Buchinger, Vöcklabruck; Bruno Mistlberger, Gschwandt; Rudolf Wolf, Lenzing; Johann Schönberger, Zipf; Thomas Langer, Gmunden; Johann Bloo, Seewalchen; Kurt Vilsecker; Bruno Haider, both of Gmunden, all of Austria

[73] Assignee: Lenzing Aktiengesellschaft, Austria

[21] Appl. No.: 48,461

[22] Filed: May 11, 1987

Related U.S. Application Data

[63] Continuation of Ser. No. 832,845, Feb. 24, 1986, abandoned.

[30] Foreign Application Priority Data

Oct. 10, 1985 [AT] Austria ..... 2936/85

[51] Int. Cl.[4] ..... D03D 37/00

[52] U.S. Cl. ..... 139/13 R; 139/13 A; 139/15

[58] Field of Search ..... 139/13 R, 13 A, 14, 139/15, 16, 17, 436

[56] References Cited

U.S. PATENT DOCUMENTS 338,620 5/1943 Pelce ..... 139/15
4,479,517 10/1984 Plammer et al. ..... 139/13 R

FOREIGN PATENT DOCUMENTS 2923655 12/1980 Fed. Rep. of Germany .... 139/13 R
800161 1/1980 South Africa ..... 139/13 R

*Primary Examiner*—Henry S. Jaudon

[57] ABSTRACT

For the production of a tubular woven fabric having a floats-including weave, by using a circular loom, at least two shuttles are moved through sheds formed by warp threads. The warp threads are guided through thread eyes of thread guiding organs and are lifted and lowered by the thread guiding organs to form the shed. In order to be able to produce tubular woven fabrics of different types of floats-including weaves, free warp threads, i.e., warp threads that are loosely guided through between thread guiding organs carrying neighboring warp threads, additionally run between warp threads guided by the thread guiding organs. These loose warp threads cross the opened shed approximately in the middle thereof and are lifted by a guide means arranged on at least one shuttle and, as the method proceeds, are lowered by a guide means arranged on at least one shuttle.

8 Claims, 10 Drawing Figures

Warp guiding bow diverting warp thread upwardly

Warp guiding bow diverting warp thread downwardly

Warp thread drawn in through thread eye and moved by thread guiding organ

Warp thread freely drawn in and moved by warp guiding bow

METHOD OF PRODUCING A TUBULAR WOVEN FABRIC AND A CIRCULAR LOOM FOR CARRYING OUT THE METHOD

This application is a continuation of Ser. No. 832,845 filed Feb. 24, 1986 by Johann Buchinger, Bruno Mistlberger and Rudolf Wolf, now abandoned.

The invention relates to a method of producing a tubular woven fabric, in particular for bags, having a floats-comprising weave, by using a circular loom in which at least two shuttles are moved through sheds formed by warp threads, wherein warp threads are guided through thread eyes of thread guiding organs and are lifted and lowered by means of the thread guiding organs to form the shed, to a circular loom for carrying out the method and to a bag made of a tubular woven fabric produced according to the method of the invention.

There is the demand, for the transportation and storage of granular stock, such as rice, cereal grains, etc., that the transport bags should have a relatively coarse, antiskid surface in order to reduce the danger of slipping when stacked one above the other. For antiskid bags, fabrics are used, that comprise weaves with floating warp and/or weft threads.

It is known (ZA-patent No. 80/0161) to use a circular loom having a plurality of heddle frames to weave a tubular fabric for such bags, wherein each heddle frame comprises several heddles and at least one shuttle has a tip that is offset relative to the cross shed or relative to the lower shed, with respect to the central line.

To produce a weave including floating threads, in the known circular loom, heddles with elongated eyes are provided whose lengths correspond to at least half the stroke of the heddle frame. The heddles comprising elongated eyes, according to the weave type desired, are provided in different formations between conventional heddles having normal thread eyes.

This known circular loom has the disadvantage that, depending on the provision of heddles having elongated eyes, it is possible to weave only one tubular fabric of one particular weave type at a time, and that weaving of a tubular fabric having a plain weave or any other type of weave is possible only after resetting of the circular loom, i.e., only after having exchanged the heddle frame and the shuttles. In order to meet the wishes of various customers, the operator of such a circular loom is forced to store different heddle frames and to put up with resetting times.

The invention aims at avoiding these disadvantages and difficulties and has as its object to provide a method of the initially defined kind as well as a circular loom for carrying out the method, by which tubular woven fabrics of different types of weaves including floats, may be produced, a changeover from one weave type to another being easily and readily feasible. Furthermore, the changeover from one weave type to another weave type is to be carried out by the weaver without the help of a mechanic.

This object is achieved with a method of the initially described kind in that free warp threads, i.e., warp threads that are loosely guided through between thread guiding organs carrying neighboring warp threads, additionally run between warp threads guided by the thread guiding organs, which free warp threads cross the opened shed approximately in the middle thereof and are lifted by a guide means arranged on at least one shuttle and, as the method proceeds, are lowered by a guide means arranged on at least one shuttle.

Thereby, it is possible to produce tubular woven fabrics of various weaves with floats, or even a tubular woven fabric having a plain weave, as desired, without change at the heddles and without replacement of shuttles.

A circular loom for carrying out the method, which comprises thread guiding organs carrying thread eyes and being movable relative to one another by a control unit in order to form a shed, at least two shuttles, as well as a drive means for moving the shuttles through the opened sheds, is characterized in that a warp-thread guiding bow having a tip upwardly offset with respect to the center of the shed is provided on at least one shuttle and a warpthread guiding bow having a tip downwardly offset with respect to the center of the shed is provided on at least one further shuttle, and that between thread guiding organs carrying neighboring warp threads a free space directed transverse to the longitudinal extension of the warp threads is provided for threading through additional warp threads.

Preferably, bags can be made of a tubular woven fabric produced according to the method of the invention, whose weave type is characterized in that:

(a) every third and sixth warp thread of a six-thread warp repeat from a circular loom, which comprises warp threads guided through the thread eyes of thread guiding organs, is replaced by a loose warp thread, and that four shuttles are provided to interweave the weft threads, two adjacently circulating shuttles of which comprise a guiding means lifting the loose warp threads and the remaining two shuttles comprise a guiding means lowering the loose warp threads, or (b) that every second, third, seventh and ninth warp thread of a ten-thread warp repeat from a circular loom, which comprises warp threads guided through the thread eyes of thread guiding organs, is replaced by a loose warp thread, and that four shuttles are provided to interweave the weft threads, two adjacently circulating shuttles of which comprise a guiding means lifting the loose warp threads and the remaining two shuttles comprise a guiding means lowering the loose warp threads, or (c) that every second, fourth and seventh warp thread of an eigth-thread warp repeat from a circular loom, which comprises warp threads guided through the thread eyes of thread guiding organs, is replaced by a loose warp thread, and that four shuttles are provided to interweave the weft threads, two adjacently circulating shuttles of which comprise a guiding means lifting the loose warp threads and the remaining two shuttles comprise a guiding means lowering the loose warp threads, or (d) that every fourth warp thread of a four-thread warp repeat from a circular loom, which comprises warp threads guided through the thread eyes of thread guiding organs, is replaced by a loose warp thread, and that four shuttles are provided to interweave the weft threads, one shuttle of which comprises a guiding means lowering the loose warp threads and three shuttles of which comprise a guiding means lifting the loose warp threads, or (e) that every second warp thread of a four-thread warp repeat from a circular loom, which comprises warp threads guided through the thread eyes of thread guiding organs, is replaced by a loose warp thread, and that four shuttles are provided to interweave the weft threads, one shuttle of which comprises a guiding means lowering the loose warp threads and three shuttles of which comprise a guiding means lifting the loose warp threads, or (f) that every second, fifth and seventh warp thread of an eight-thread warp repeat from a circular loom, which comprises warp threads guided through the thread eyes of thread guiding organs, is replaced by a loose warp thread, and that four shuttles are provided to inter weave the weft threads, one shuttle of which comprises a guiding means lowering the loose warp threads and three shuttles of which comprise a guiding means lifting the loose warp threads.

The invention will now be explained in more detail by way of an embodiment illustrated in FIGS. 1 to 4, wherein.

Figure 1:
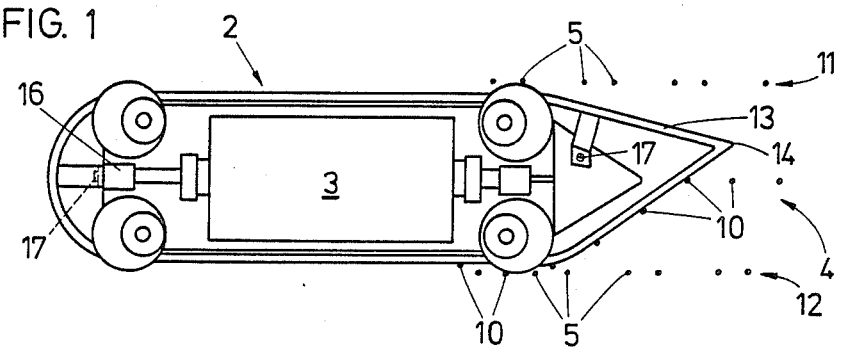
FIGS. 1 and 2 are side views of shuttles that are moved through an opened shed.
Figure 2:
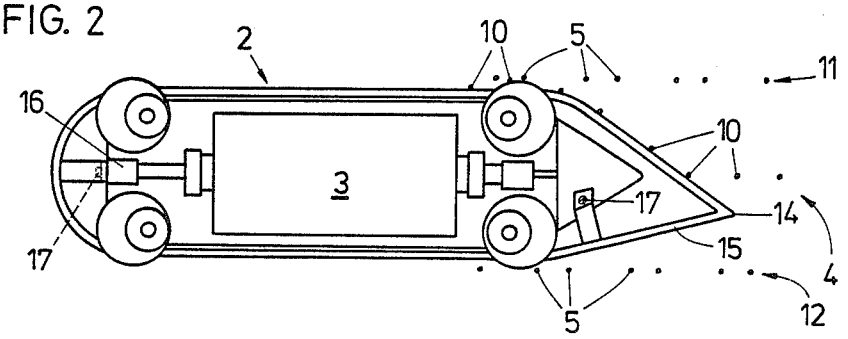
Figure 4:
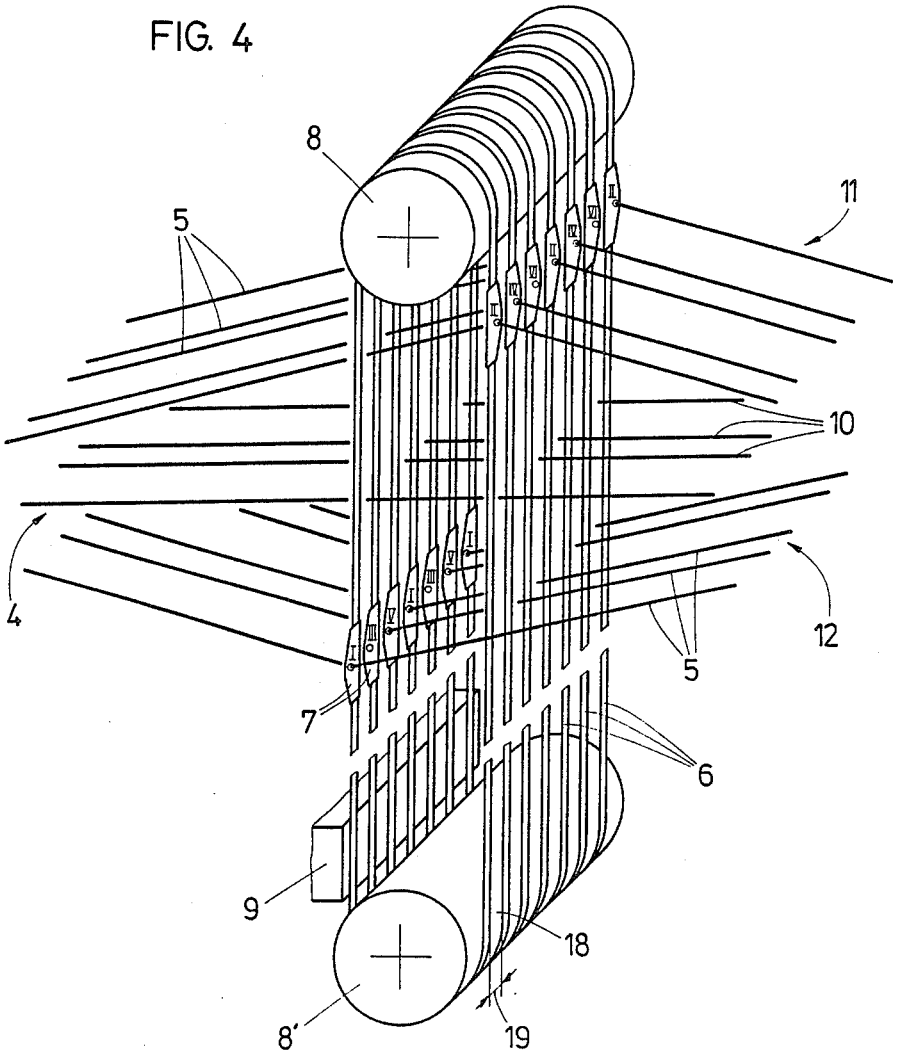
Figure 5:
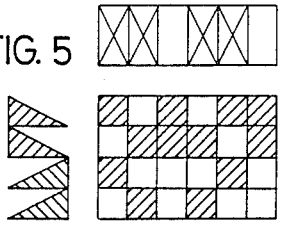

FIG. 4 schematically illustrates the draft into a heddle of a circular loom;

FIGS. 5 to 10 illustrate various weave types of tubular woven fabrics produced according to the method of the invention, the warp arrangement shown in FIGS. 1, 2 and 4 being chosen in accordance with the weave type illustrated in FIG. 5.

As is illustrated in FIGS. 1 and 2, the weft threads 1 are guided through an open shed 4 by means of conventional shuttles 2 each carrying a weft bobbin 3 and are supported in a conventional manner, between an upper and a lower running ring as shown, for instance, in U.S. Pat. No. 4,479,517. To guide the warp threads 5, thread guiding organs 6, which are designed as flexible bands directly carrying thread eyes 7, are provided, as is apparent from FIG. 4, several bands 6 each being commonly guided over upper and lower deflection pulleys 8, 8' and commonly movable by means of a catch element 9 fastened to them, as is shown, for instance, in U.S. Pat. No. 4,479,517.

To produce a woven fabric having the weave illustrated in FIG. 5 with a warp repeat of six warp threads, every third and sixth warp thread 10 is not threaded through the thread eye 7 of a thread guiding organ 6, but is loosely guided through between the thread guiding organs 6. The loose warp threads 10 cross the opened shed 4 approximately in the middle thereof. The third and sixth thread eyes 7—for reasons of clarity the thread eyes 7 are provided with the numerals I to VI in accordance with the warp repeat of six threads—bearing the numerals III and VI, thus, are each empty, corunning freely without moving a warp thread 5.

Figure 3:
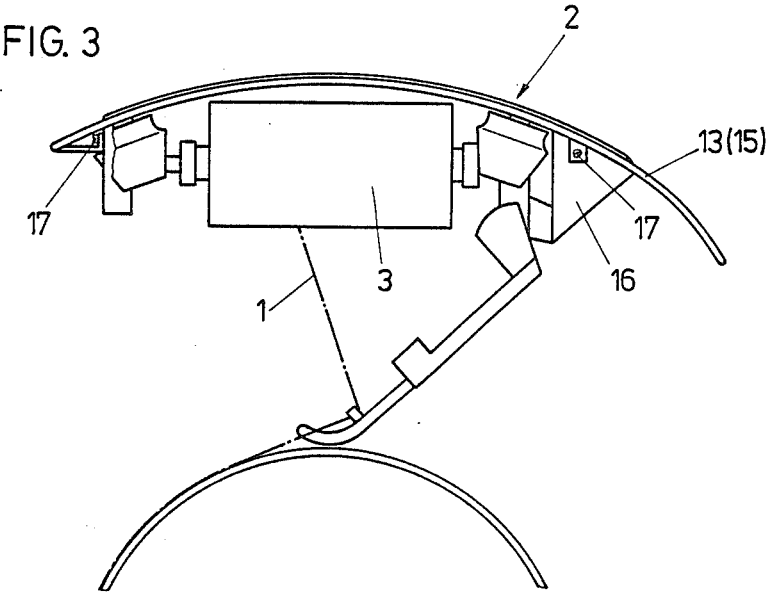
FIG. 3 is a top view of the shuttle from above.

In order to move the warp threads 10 centrally crossing the opened shed 4 relative to the warp threads forming the cross shed 11 and the lower shed 12, respectively, in the right order—so as to produce the weave illustrated in FIG. 5—, in a circular loom comprising four shuttles 2, two consecutive shuttles 2 each carry a warp guiding bow 13 having a tip 14 upwardly offset with respect to the center of the shed 4 and the two other shuttles 2 carry a warp guiding bow 15 having a tip 14 downwardly offset with respect to the center of the shed 4. As is apparent from FIGS. 1 to 3, the warp guiding bows 13, 15 are fastened to the bodies 16 of the shuttles so as to be readily dismountable, for instance, by means of screws 17, so that a replacement of the warp guiding bows 13, 15, or a removal of the same from the shuttles 2, may be carried out in a simple way. Furthermore, it is possible to install the warp guiding bows 13, 15 into conventional circular looms, for instance, into that disclosed in U.S. Pat. No. 4,479,517, at a later time in order to produce a weave including floats.

In order to prevent the free loose warp threads 10, i.e., those lying between the thread guiding organs 6, from rubbing against the thread guiding organs 6, a free space 18 of a width 19 is provided between thread guiding organs 6 carrying neighboring warp threads 5, which space extends in a direction transverse to the warp threads 5.

Figure 7:
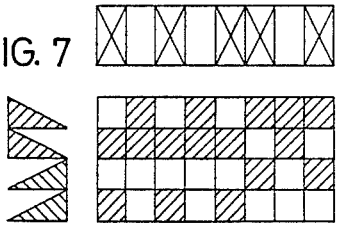

The weave illustrated in FIG. 5 yields a fabric that exhibits a particularly good coarseness in the warp and weft directions. With the weave illustrated in FIG. 6, which comprises a warp repeat of ten warp threads and weft floats over five threads, the weft threads 1 are also guided by means of four shuttles 2, wherein two adjacently guided shuttles 2 comprise warp guiding bows 13 having tips 14 upwardly offset with respect to the center of the shed 4 and the two other shuttles 2 each carry a warp guiding bow 15 having a tip 14 downwardly offset with respect to the center of the shed. The weave illustrated in FIG. 7 is a combination of parts of the weaves illustrated in FIGS. 5 and 6.

Figure 8:
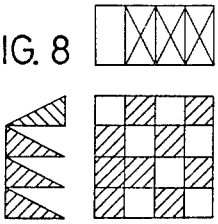
Figure 6:
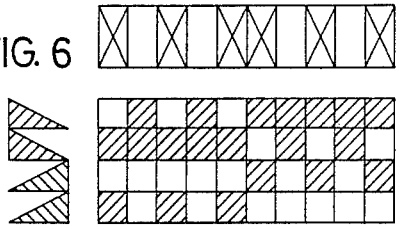
Figure 9:
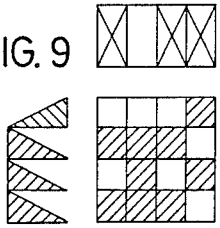
Figure 10:
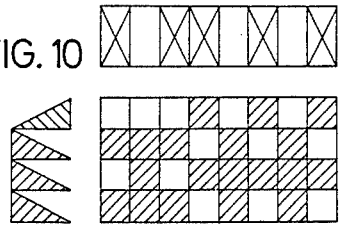
Figure 10:
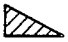
Figure 10:
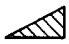
Figure 10:
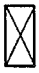
Figure 10:
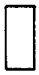

FIGS. 8 to 10 illustrate alternative advantageous weaves for bag fabrics, in which, however, only one shuttle 2 comprises a warp guiding bow 15 that diverts the free warp threads 10 upwardly and three of the four shuttles 2 each comprise a warp guiding bow 13 directing the free warp threads 10 downwardly. The weave illustrated in FIG. 10 is a combination of parts of the weaves shown in FIGS. 8 and 9.

The invention is not limited to circular looms comprising thread guiding organs 6 formed by flexible bands, but it may also be applied to circular looms comprising conventional heddles, wherein no exchange of the heddles or of the heddle-carrying frame is required to produce weaves including floats. It merely suffices to mount warp guiding bows 13 or 15 to the shuttles 2, whereupon weaving of a tubular fabric having a weave different from a plain weave may be started at once without any further measures, after having threaded in the warp threads 5 and 10, respectively.

What we claim is:

1. In a circular loom for producing a tubular woven fabric of variable weave patterns, said loom including shedding means comprising thread guiding organs consisting of a plurality of thread eyes carried by a plurality of flexible bands, said thread eyes corresponding in number with the number of warp threads and drive means for moving said thread guiding organs relative to each other so as to lift and lower warp threads which extend through said eyes to form sheds, at least two shuttles which are driven through open sheds, a first warp thread guiding bow mounted to one of said shuttles and having a tip offset upwardly with respect to the center of said shed, a second warp thread guiding bow mounted to at least a further one of said shuttles and having a tip offset downwardly with respect to the center of said shed, and each of said guiding bows being selectively repositionable with respect to the respective shuttle on which it is mounted between a first position wherein said tip is offset upwardly with respect to the center of said shed and a second position wherein said tip is offset downwardly with respect to the center of said shed, said drive means mounting said flexible bands transversely across the warp in a spaced side by side arrangement of sufficient width to form free spaces therebetween, so that selected ones of said warp threads pass through their corresponding thread eyes and are controlled by the shedding means, and others pass through the free spaces of said thread guiding organs adjacent their corresponding thread eyes and are lowered and lifted by said first and second warp thread guiding bows, respectively.

2. A method of producing a tubular woven fabric of variable weave patterns, said method being performed by using a circular loom including shedding means comprising thread guiding organs consisting of a plurality of thread eyes carried by a plurality of flexible bands, said flexible bands corresponding in number with the number of warp threads and capable of carrying said corresponding warp threads and being spaced side by side across the width of the warp to form therebetween free spaces, said method including the steps of:

guiding selected ones of said warp threads through their corresponding thread eyes and operating said thread guiding organs to raise and lower said warp threads so as to form sheds;

guiding others of said warp threads through the free spaces of said thread guiding organs adjacent their corresponding thread eyes, said others of said warp threads comprising loose warp threads, said loose warp threads crossing an opened shed approximately centrally thereof;

moving at least two shuttles through said sheds;

utilizing deflection guide means mounted on at least one of said shuttles to lift said loose warp threads; and utilizing additional guide means mounted on at least an additional one of said shuttles to thereafter lower said loose warp threads.

3. A method as set forth in claim 2 also comprising the steps of:

arranging the guided warp threads and the loose warp threads in a six-thread warp repeat in which every third and sixth warp thread thereof is constituted by said loose warp threads;

utilizing four of said shuttles for interweaving said weft threads with said guided warp threads and said loose warp threads; and providing two neighboring ones of said shuttles with an individual one of said first guide means for lifting said loose warp threads and providing the remaining two of said shuttles with an individual one of said second guide means for lowering said loose warp threads.

4. A method as set forth in claim 2 also comprising the steps of:

arranging the guided warp threads and the loose warp threads in a ten-thread warp repeat in which every second, fourth, seventh and ninth warp thread thereof is constituted by said loose warp threads;

utilizing four of said shuttles for interweaving said weft threads with said guided warp threads and said loose warp threads; and providing two neighboring ones of said shuttles with an individual one of said first guide means for lifting said loose warp threads and providing the remaining two of said shuttles with an individual one of said second guide means for lowering said loose warp threads.

5. A method as set forth in claim 2 also comprising the steps of:

arranging the guided warp threads and the loose warp threads in an eight-thread warp repeat in which every second, fourth and seventh warp thread thereof is constituted by said loose warp threads;

utilizing four of said shuttles for interweaving said weft threads with said guided warp threads and said loose warp threads; and providing two neighboring ones of said shuttles with an individual one of said first guide means for lifting said loose warp threads and providing the remaining two of said shuttles with an individual one of said second guide means for lowering said loose warp threads.

6. A method as set forth in claim 2 also comprising the steps of:

arranging the guided warp threads and the loose warp threads in a four-thread warp repeat in which every first warp thread thereof is constituted by said loose warp threads;

utilizing four of said shuttles for interweaving said weft threads with said guided warp threads and said loose warp threds; and providing one of said shuttles with said second guide means for lowering said loose warp threads and providing the remaining three of said shuttles with an individual one of said first guide means for lifting said loose warp threads.

7. A method as set forth in claim 2 also comprising the steps of:

arranging the guided warp threads and the loose warp threads in a four-thread warp repeat in which every second warp thread thereof is constituted by said loose warp threads;

utilizing four of said shuttles for interweaving said weft threads with said guided warp threads and said loose warp threads; and providing one of said shuttles with said second guide means for lowering said loose warp threads and providing the remaining three of said shuttles with an individual one of said first guide means for lifting said loose warp threads.

8. A method as set forth in claim 2 also comprising the steps of:

arranging the guided warp threads and the loose warp threads in an eight-thread warp repeat in which every second, fifth and seventh warp thread thereof is constituted by said loose warp threads;

utilizing four of said shuttles for interweaving said weft threads with said guided warp treads and said loose warp threads; and providing one of said shuttles with said second guide means for lowering said loose warp threads and providing the remaining three of said shuttles with an individual one of said first guide means for lifting said loose warp threads.

* * * * *